United States Patent [19]

Gazzarrini

[11] Patent Number: 4,516,513

[45] Date of Patent: May 14, 1985

[54] METHOD AND APPARATUS FOR APPLYING A PATCH TO MANUFACTURED GOODS

[75] Inventor: Vinicio Gazzarrini, Florence, Italy

[73] Assignee: Solis S.r.l., Florence, Italy

[21] Appl. No.: 362,974

[22] Filed: Mar. 29, 1982

Related U.S. Application Data

[62] Division of Ser. No. 107,426, Dec. 26, 1979.

[30] Foreign Application Priority Data

Jan. 9, 1979 [IT] Italy ..... 9311 A/79

[51] Int. Cl.[3] ..... D05B 1/00; D05B 97/00

[52] U.S. Cl. ..... 112/262.2; 112/121.15

[58] Field of Search ..... 112/121.15, 262.2, 121.12, 112/121.11, 262.1; 223/43, 112

[56] References Cited

U.S. PATENT DOCUMENTS 3,669,047 6/1972 Hedegaard ..... 112/121.15

4,220,104 9/1980 Humphreys ..... 112/121.15 X

FOREIGN PATENT DOCUMENTS 462086 4/1978 Spain ..... 112/121.15

*Primary Examiner*—H. Hampton Hunter

*Attorney, Agent, or Firm*—McAulay, Fields, Fisher, Goldstein & Nissen

[57] ABSTRACT

A method for applying a gusset to tubular articles such as women's pantyhose, which includes arranging the pantyhose across a hollow support with the edge of a seamless fabric stretched along a horizontal contour of a closed loop; reversing the body of the pantyhose, arranging a gusset over the pantyhose shaped to conform to the closed loop shape of the support, and sewing the superposed edges of the gusset and the stretched zone of the pantyhose together.

20 Claims, 13 Drawing Figures

METHOD AND APPARATUS FOR APPLYING A PATCH TO MANUFACTURED GOODS

This is a division of application Ser. No. 107,426 filed Dec. 26, 1979.

This invention relates to a method of applying gussets to pantyhose. More specifically, this invention relates to applying gussets to pantyhose formed as a single unit without a seam in the crotch, and provides a reinforcing gusset for the seamless crotch zone.

At present it is known to form women's pantyhose with a gusset or reinforcing a member by joining two spearately made tubular shaped legs by sewing. Coincident with the sewing of the two leg portions together, a reinforcing gusset, which overlaps the edges of the leg portions, is sewn thereon.

The object of the present invention is to provide a method for applying a gusset to tubular articles in general such as women's pantyhose.

According to the invention, these results have been achieved by adopting the idea of utilizing a tubular article, made separately by known means, formed by a pantyhose without gusset and lacing the seam at the crotch; stretching the edge of the seamless zone of the article according to the form of the gusset to be applied; placing thereon a gusset of a form and dimensions adapted to cover the zone free of fabric of the stretched article; and, removing the ready-made article with the gusset.

BRIEF DESCRIPTION OF THE INVENTION

Advantages and characteristics of the invention will be better understood by any technician in the field from the description which follows and from the annexed drawings, which show a schematic exemplification of a machine usable to practice the method according to the present invention and wherein.

DESCRIPTION OF PREFERRED EMBODIMENT

Reduced to its essential structure, the method for applying a gusset, e.g. a circular one, to tubular articles and in particular women's pantyhose (FIGS. 11–13) according to the present invention, includes: (a) stretching and fastening by hand the edge of the seamless crotch zone of a pantyhose, made separately by known means, on the horizontal edge of a support in the form of an inverted funnel so that the article is in a hanging position relative to the support; (b) pneumatically turning the body of the article over and introducing therein the legs thereof so that the edge of the fabric on which the gusset must be applied is ready for sewing; (c) mechanically placing a gusset, e.g. a circular one (FIG. 13), on a horizontal circular support plate; (d) mechanically laying said plate with the gusset thereon on the aforesaid funnel-shaped support so that the edge of the gusset is pressed and held fixed in juxtaposition to the stretched edge of the seamless zone of the article; (e) trimming the excess fabric beyond the seam line, of the article and of the gusset, simultaneously; (f) sewing the gusset to the article along the superposed edges; (g) pneumatically turning the ready-made article with gusset right side out again and removing it from the support.

Figure 1:
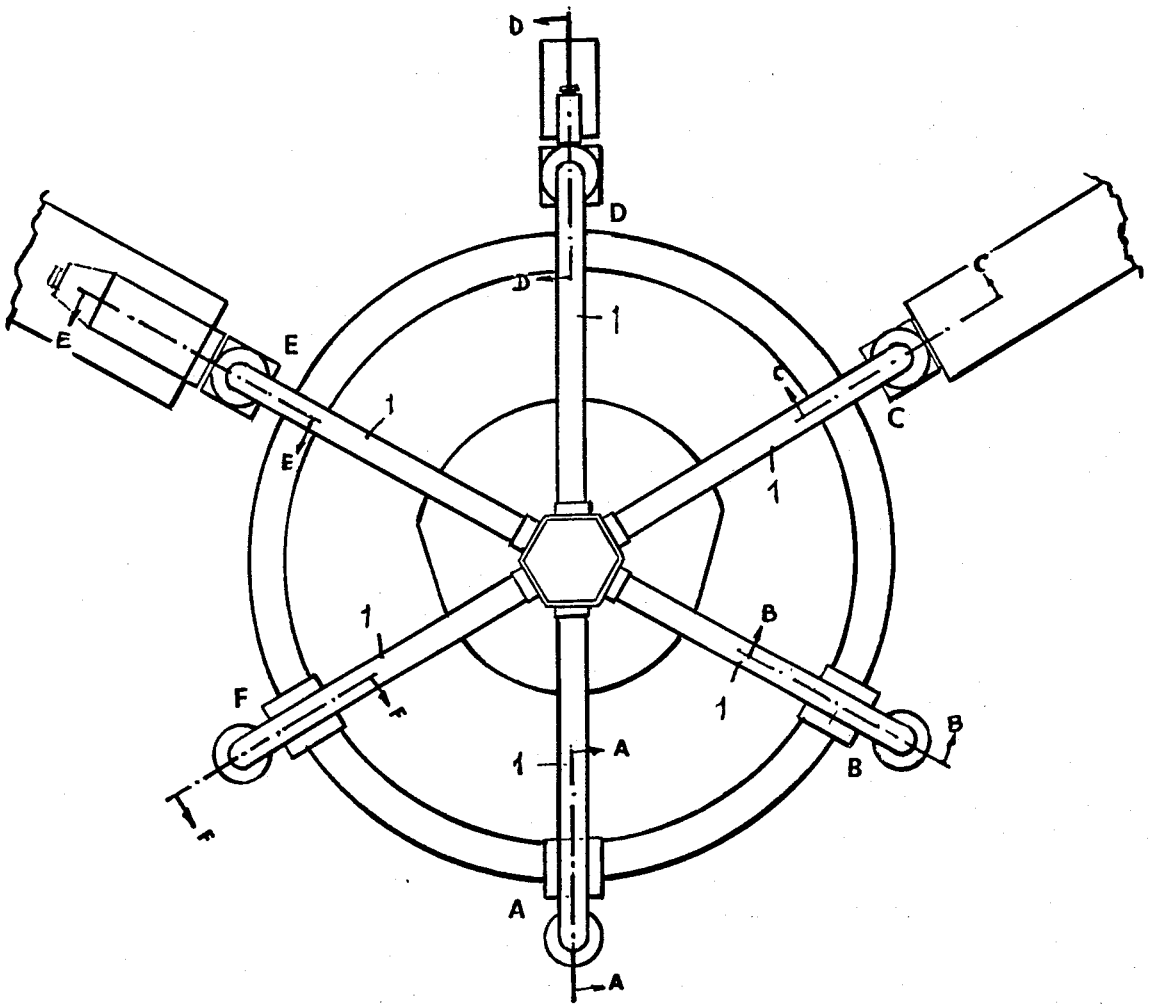
FIG. 1 is a schematic top plan view of a machine with several stations, according to the invention.
Figure 2:
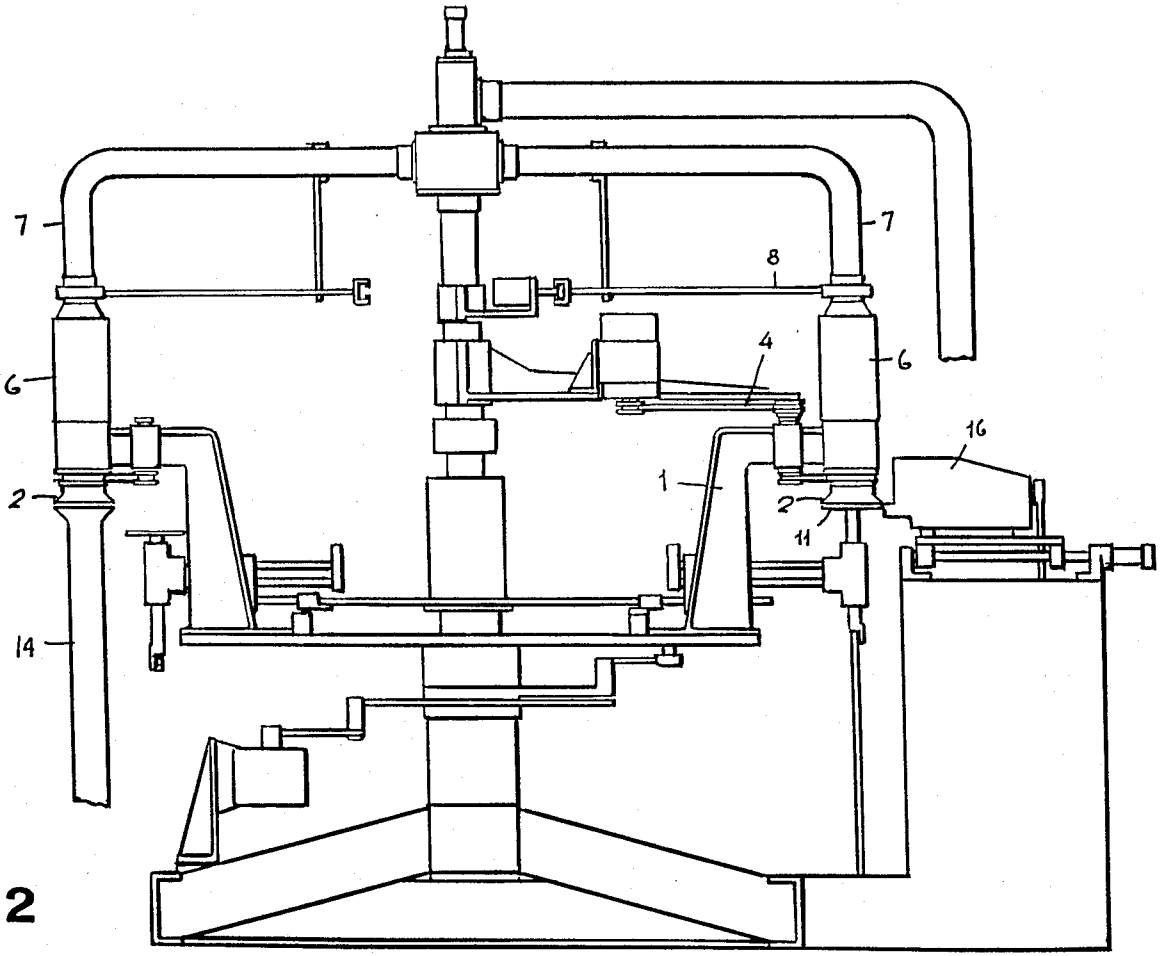
FIG. 2 is an elevational view of said machine.
Figure 4:
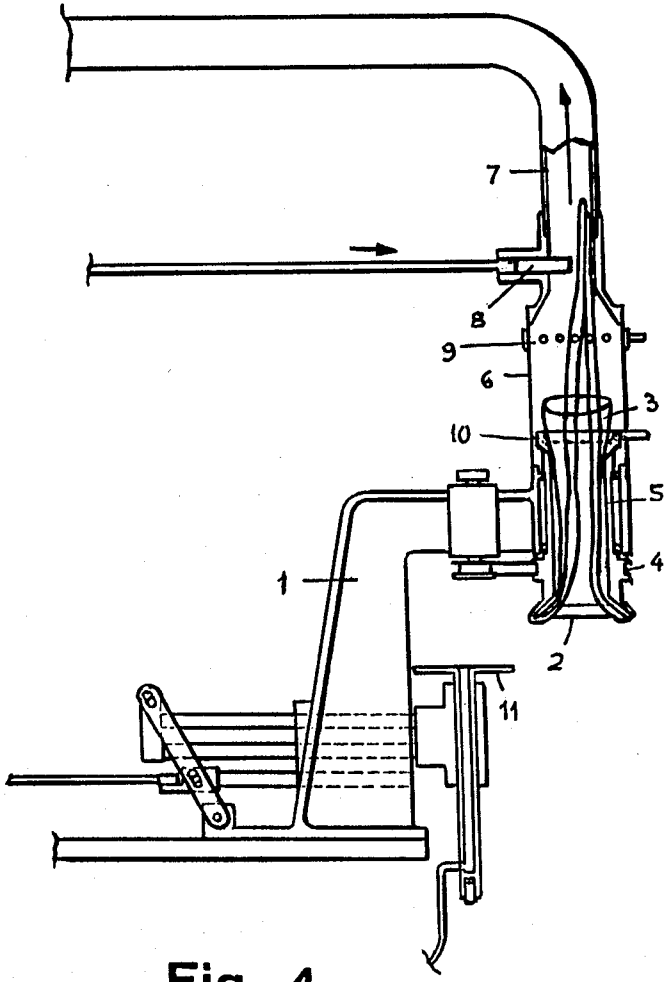
FIG. 4 is a section along BB of FIG. 1 showing the article in the arrangement of reversed positioning.
Figure 3:
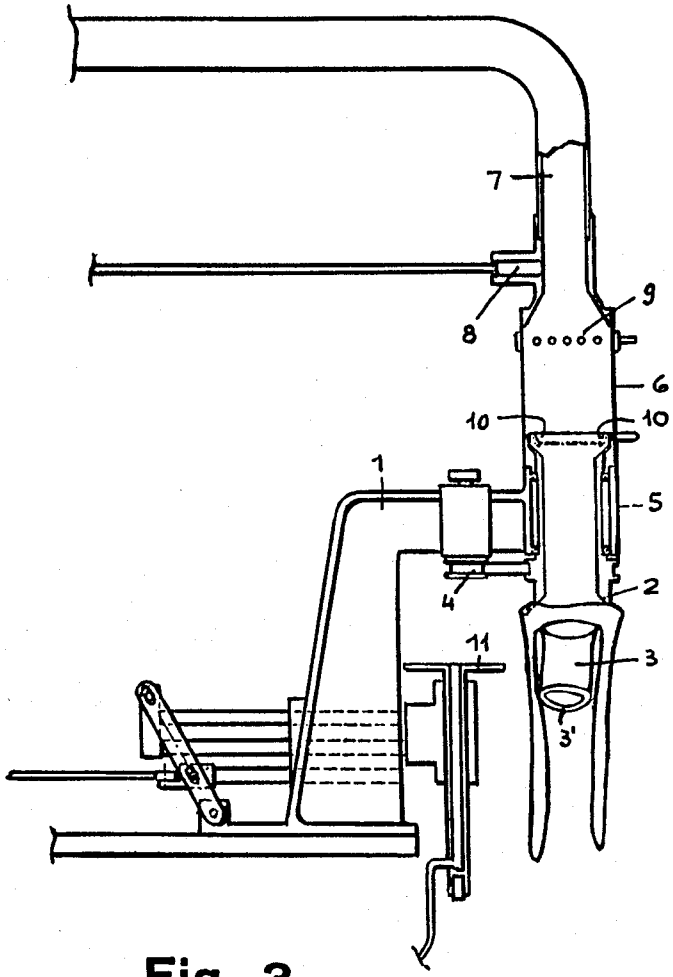
FIG. 3 is a section along AA of FIG. 1 showing the article in the arrangement of initial positioning.
Figure 6:
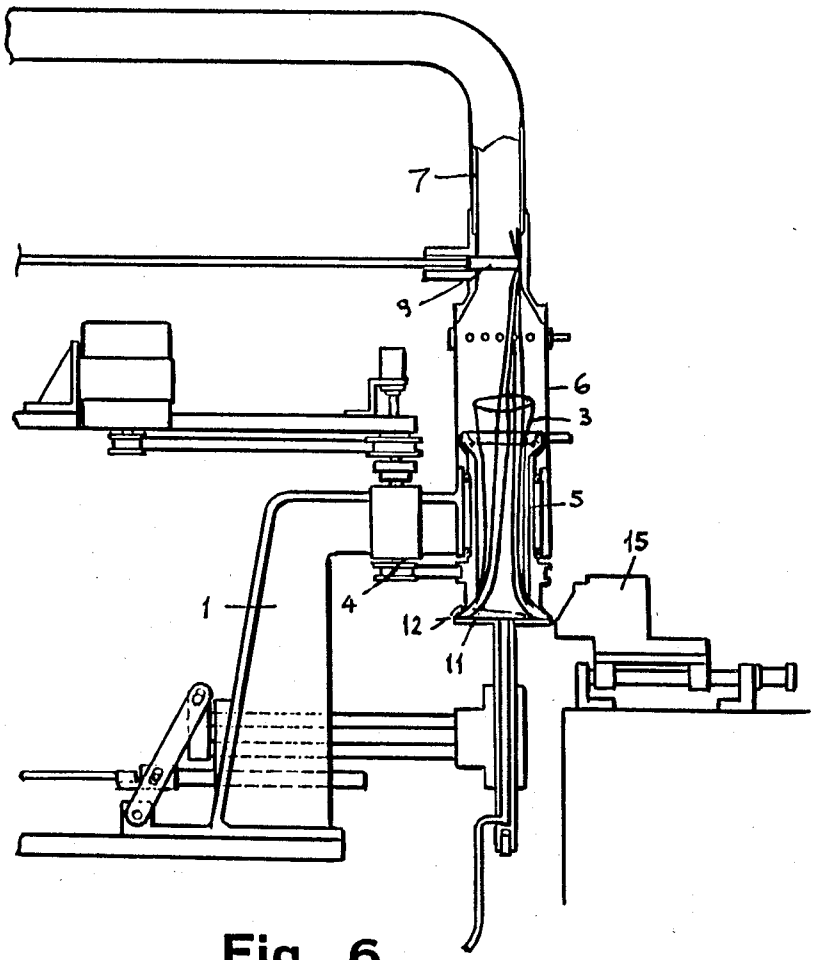
FIG. 6 is a section along DD of FIG. 1 showing the article in the position for trimming the excess fabric of the gusset of the article.
Figure 5:
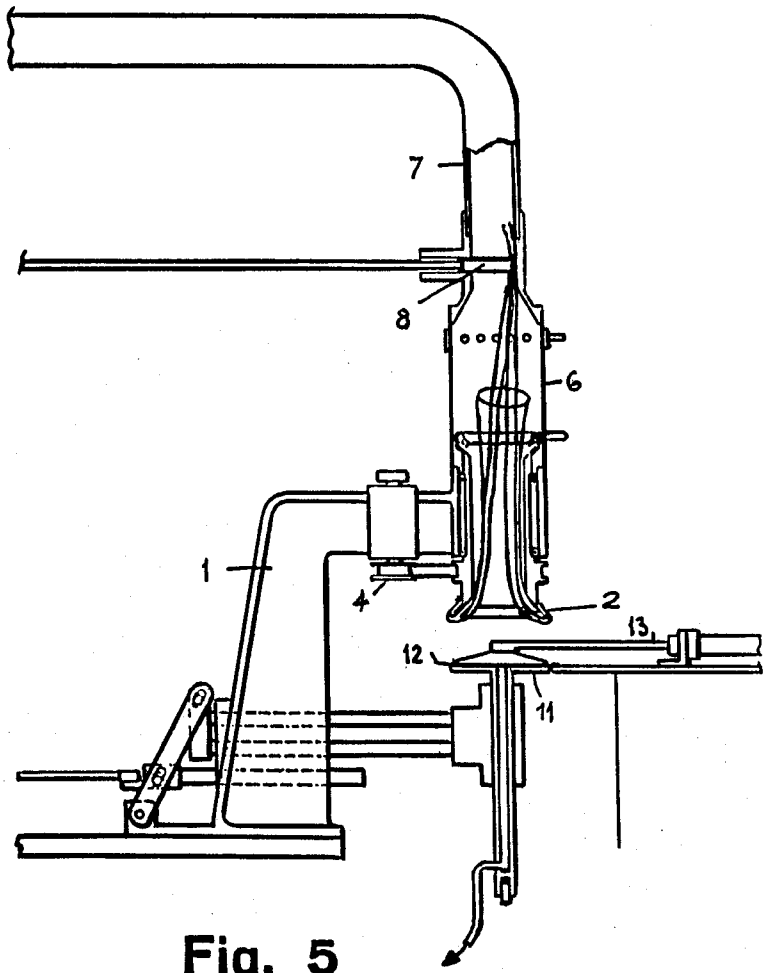
FIG. 5 is a section along CC of FIG. 1 showing the placing on of the gusset.
Figure 8:
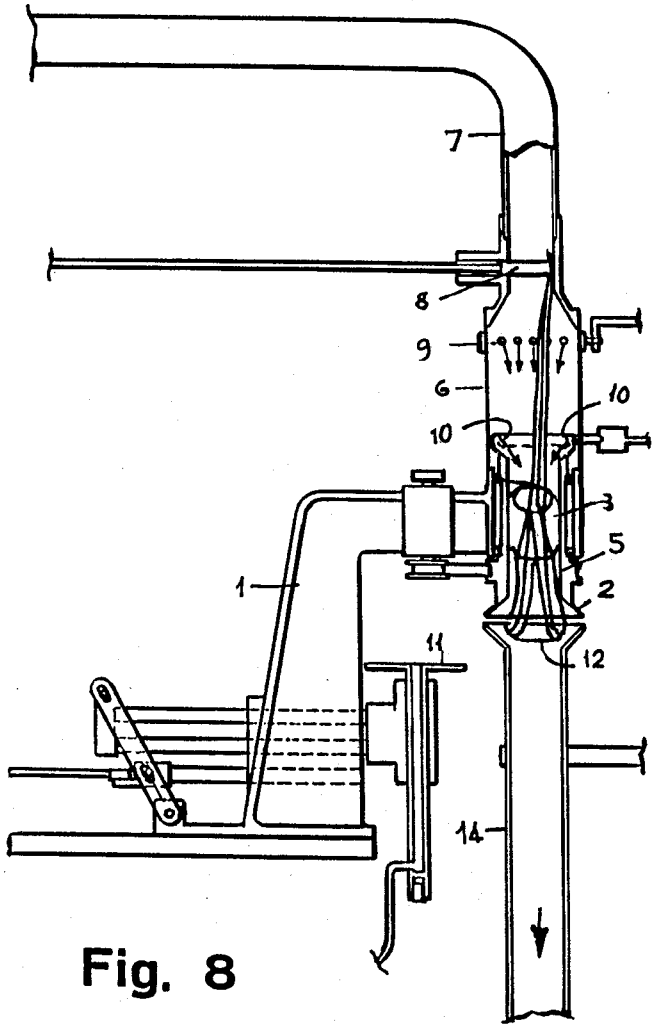
FIG. 8 is a section along FF of FIG. 1 showing the finished article detached from the support 2.
Figure 7:
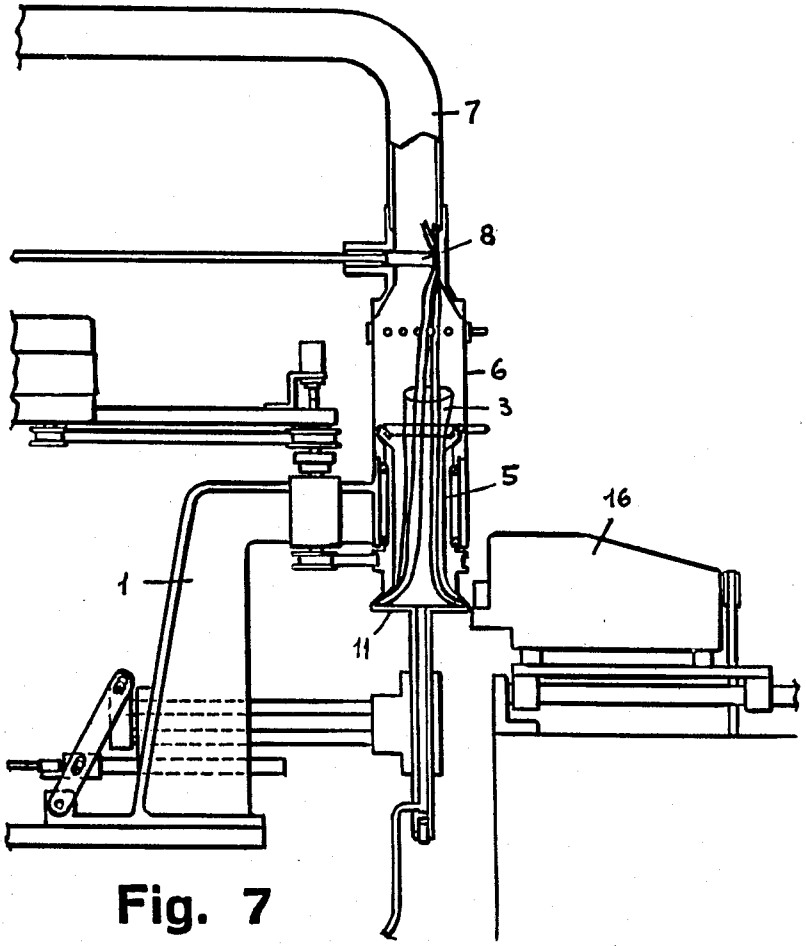
FIG. 7 is a section along EE of FIG. 1 showing the article held in position for sewing the gusset.
Figure 10:
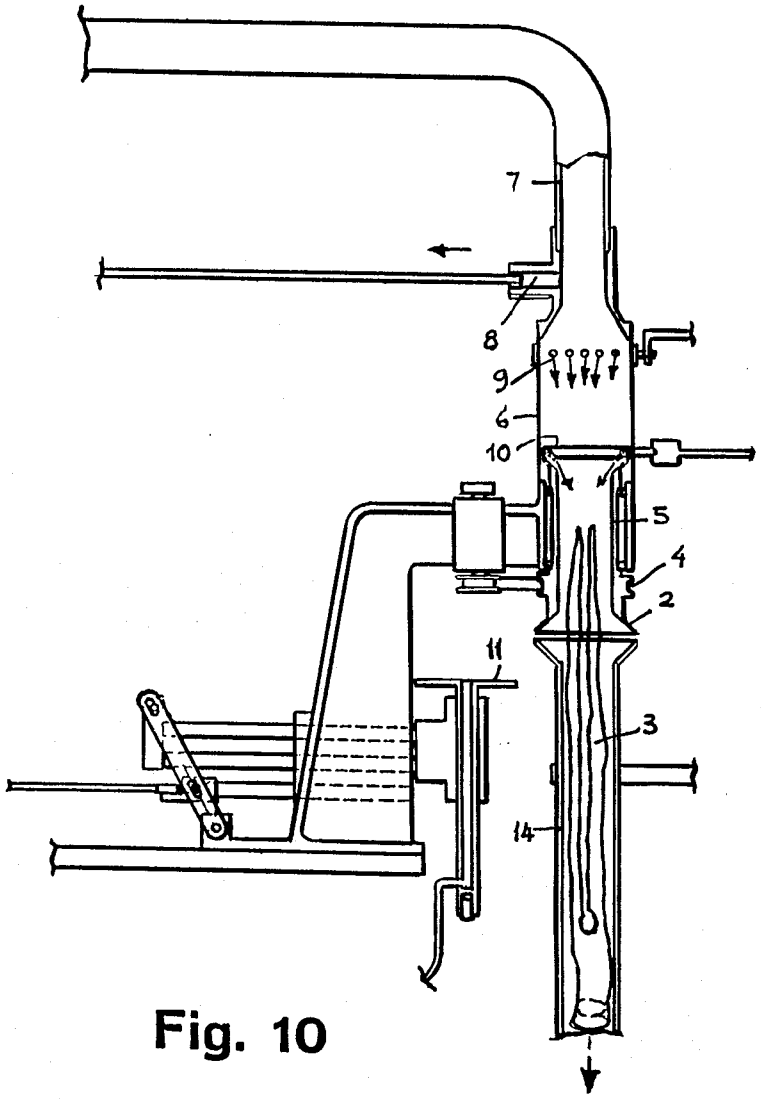
FIG. 10 is a section along FF of FIG. 1 showing the finished article as it is being removed from the machine.
Figure 9:
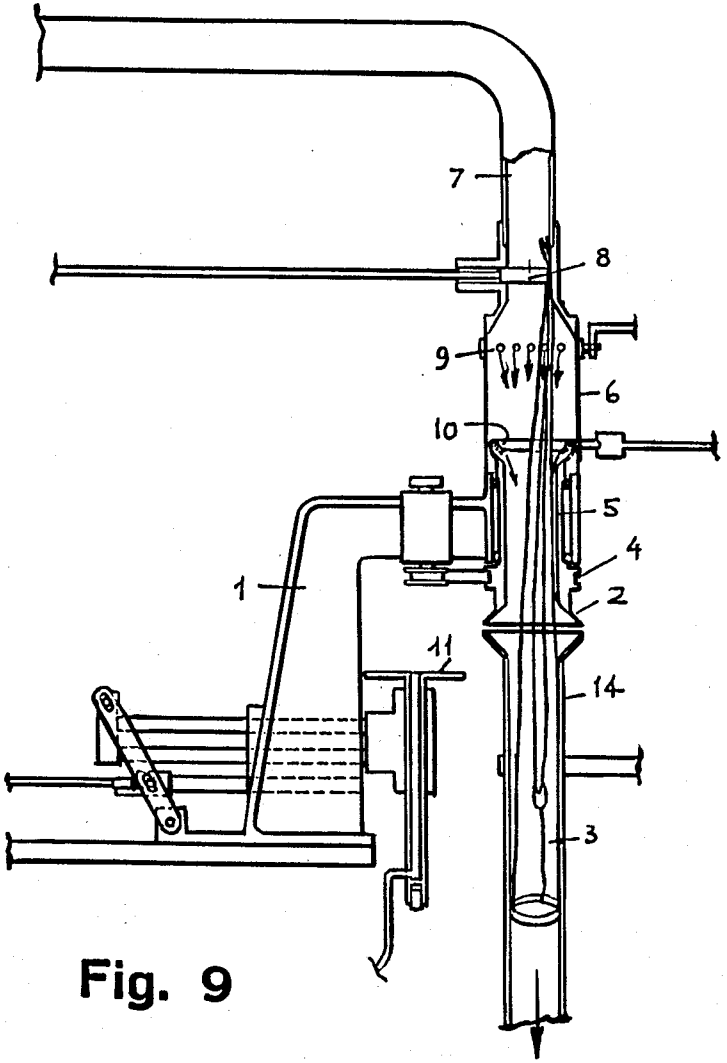
FIG. 9 is a section along FF of FIG. 1 showing the finished article after it has been turned right side out again.
Figure 11:
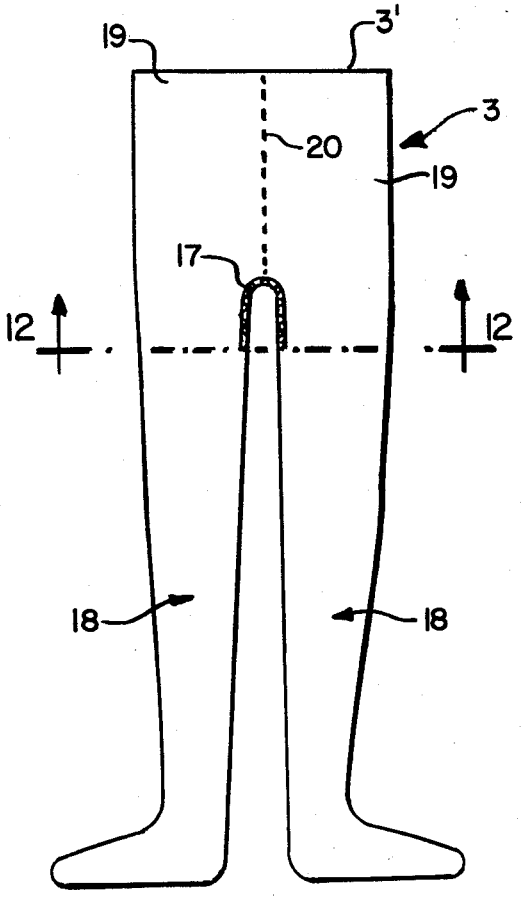
FIG. 11 is a front elevational view of a completed pantyhose article formed by the present invention.
Figure 12:
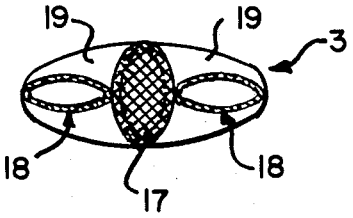
FIG. 12 is a sectional view of FIG. 11 taken through line 12—12 of FIG. 11.
Figure 13:
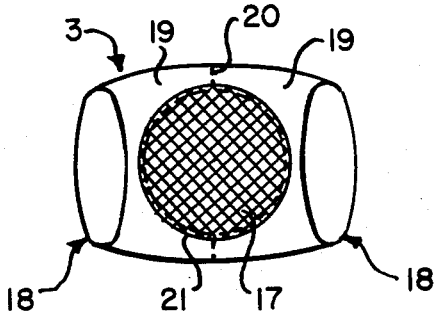
FIG. 13 is a view similar to FIG. 12 showing the pantyhose article stretched to illustrate the flattened shape of a gusset.

For a better understanding of the method, reference is made to FIGS. 11–13 which illustrate a completed pantyhose article 3 of the type discussed above, which the present invention is intended to complete automatically. As illustrated in FIGS. 11–13, body portion 19, 19 sewn together at seam 20 is provided with a gusset 17 over the stretched out portion or seamless zone 21. When the two tubular halves 18, 18 are sewn together without a gusset, the interconnection of pantyhose halves 18, 18 is subject to tearing in the crotch region. Therefore, gusset 17 spans zone 21 to remove the tension which each pantyhose half 18, 18 subjects to the other upon being sewn directly together. Gusset 17 covers zone 21 and is sewn thereover by the present invention machine so that the two halves 18, 18 are not sewn directly together.

As to the machine for carrying out said method in accordance with the invention and with reference to the attached drawings FIGS. 1–10, it comprises, essentially:

a six-armed carrousel type structure 1 intermittently rotating horizontally, with stops at each of the six stations, which are, respectively; One (A) for laying the article while the edge of the seamless zone is being stretched; one (B) for pneumatically turning the article over; one (C) for laying the gusset with its edge superposed on the stretched edge of the article; one (D) for trimming excess portions of fabric of the article and of the gusset beyond the seam line; one (E) for sewing the gusset to the article; one (F) for pneumatically turning the ready-made article with the gusset right side out again and discharging it.

More particularly, at the free end of each arm 1, a support 2 in the form of an inverted funnel is provided, having the function of retaining a pantyhose 3 and stretching the seamless zone of the crotch, a known means 4 being provided for setting said support 2 in horizontal rotation in the cutting and sewing stations. Above said support 2 are a cylindrical guiding chamber 5 and a jacket 6 such as to permit the possibly elastic edge 3' of the body of the pantyhose 3 to turn over completely and to permit the pantyhose legs to slip into the body with the toe up due to the suction produced inside a tubing 7 connected to the upper end of said jacket 6, the article thus positioned presenting on the outer conical surface of the support 2 the edge of the crotch zone ready to have a gusset sewn to it. Above the jacket 6, in addition to the connection of the suction tubing 7, there is provided a horizontally traversing stop device 8, having the function of retaining the free ends of the article after they have been sucked at 7 so that the article does not fall back through the funnel-shaped support 2 when the suction at 7 ceases, known means being provided for the forward and backward movement of said stop device 8.

In addition, the wall of the jacket 6 is provided with several holes 9 with respective obturating devices, the holes being intended to be open in station F during the phase of turning right side out and discharge of the finished article; cooperating to this end is a series of compressed air cocks 10 disposed on a cylindrical collector at the top of the aforesaid chamber 5 and inclined downward and into the chamber 5.

Below each above described support 2 is provided a circular, horizontal plate 11, traversing vertically and horizontally, having the function of supporting a gusset 12 of fabric identical with or different from that of the article, placed thereon by known means 13, and of pressing it against the edge of said support 2 with interposition of the fabric of the article to which it is to be sewn, known means being provided for the horizontal radial movement toward the center of the carrousel so as to free the zone under the support 2 to enable the operator to load the article on said support 2 in station A (FIG. 3) and to make possible in station F (FIGS. 8–10) the presence of a suction duct 14 under support 2 intended to transfer the completed article with the gusset.

At the cutting station D (FIG. 6) known means 15 are provided, disposed on the exterior of the carrousel, for trimming the excess parts of fabric beyond the seam line during one complete revolution of the support 2 and also to cause said cutting means 15 to move toward and away from the support 2.

At the sewing station E (FIG. 7) a sewing machine 16 of known type is provided to carry out the sewing of the superposed edges of the gusset and of the article during one complete revolution of the support 2, and also known means are provided for causing said sewing machine 16 to move toward and away from said support 2.

At the station F (FIGS. 8–10) for discharging the finished article, known means are provided for opening the holes 9 of the jacket 6, to activate the compressed air cocks 10 and to inactivate the stop device 8.

The mode of operation is the following: During the standstill of an arm 1 of the carrousel in station A (FIG. 3), the edge of the unsewn crotch zone of a pantyhose 3 is laid by hand, while stretching it, on the lower edge of the support 2 in such a way that the article is in a hanging position illustrated in FIG. 3 of the annexed drawings. Then said arm is transferred to station B (FIG. 4) where, by pneumatic suction from duct 7, the body of the pantyhose introduces itself inside out into chamber 5, and the pantyhose legs, passing through the body, arrange themselves with the toe up in duct 7 and are held there by the stop device 8. Subsequently arm 1 transfers to station C (FIG. 5) where plate 11, on which a gusset 12 previously placed is held fixed by suction from below, rises coming up against and compressing the gusset 12 under the fabric of the article stretched on the support 2. In the next station D (FIG. 6) the support 2 is set in rotation while a cutting blade of the means 15 fixed in a position near the edge of the support 2 provides to trim the fabric of the gusset and of the article outside the stitching line. Then arm 1 moves on to station E (FIG. 7) where the sewing machine performs the continuous sewing of the gusset to the article along the entire circumference of the support 2 maintained in rotation. Lastly, as soon as arm 1 has reached station F (FIGS. 8–10) by effect of the suction from below provided in duct 14 by the opening of the holes 9 and by the action of the compressed air issuing from the cocks 10, the zone of the ready-made article with the gusset is disengaged from the support 2, and while the article is still being retained by the toes due to the device 8, the body is formed to fall down, turning itself right side out; thereafter the article, let go by 8, is sucked through 14 in straight position.

In the practice, the details of execution may vary in any equivalent manner as to form, dimensions, arrangement of the elements, nature of the materials employed without going outside the scope of the idea of solution adopted and therefore remaining within the limits of protection granted by the present patent of invention.

I claim:

1. A method for applying a gusset to tubular articles such as women's pantyhose, comprising the steps of:
   - arranging the pantyhose across a hollow support with the edge of the seamless fabric stretched along the horizontal contour of a closed loop;
   - reversing the body of the pantyhose through the hollow support;
   - arranging a gusset over the pantyhose, which gusset is shaped to conform to the closed loop shape of the support;
   - holding the gusset in place;
   - trimming the excess fabric from the gusset;
   - sewing the superposed edges of the gusset and the stretched zone of the pantyhose;
   - removing the pantyhose from the device; and,
   - reversing the pantyhose to be in its right side out position.

2. The method of claim 1 wherein the various steps are carried out simultaneously at different stations on different pantyhose articles at different stages of completion, and the removing and reversing steps are carried out pneumatically.

3. The method of claim 1, wherein the edge of the unsewn crotch of the zone of said pantyhose is stitched on the lower edge of said support in such a way that said pantyhose is in a hanging position thereover.

4. The method of claim 1, wherein said gusset is held in place over said pantyhose by suction applied from below said pantyhose.

5. The method of claim 1, wherein said support is rotated near cutting means to trim said excess fabric from said gusset.

6. A method of applying a gusset to tubular articles such as women's pantyhose, comprising the steps of:
   - arranging a pantyhose with an unsewn crotch zone across a hollow support with an edge of the unsewn crotch zone stretched along a horizontal contour of a closed loop;
   - reversing the body of the pantyhose through the hollow support to move substantially the entire portion of the pantyhose into the hollow support just leaving the edge of the unsewn crotch zone exposed;

arranging a gusset having an outer edge over the unsewn crotch zone;

holding the gusset in place;

trimming excess fabric from the gusset; and sewing the superimposed edges of the gusset and the crotch zone of the pantyhose.

7. The method of claim 6, including:

passing the legs of the pantyhose through the unsewn crotch zone with the toe section of each leg above the body portion prior to arranging the gusset; and reversing the pantyhose after sewing of the gusset to the edge of the crotch zone so that the pantyhose is in its right side out position.

8. The method of claim 6 or 7, wherein the pantyhose includes two tubular articles partially seamed together and leaving an unseamed portion to form said unsewn crotch zone for receiving the gusset to close-off the unsewn crotch zone.

9. The method of claim 8, wherein both the outer edge of said gusset and said unsewn crotch are circular.

10. The method of claim 6, including applying jets of air to the portion of the pantyhose within the hollow support after sewing of the gusset, and reversing the pantyhose after sewing thereof and drawing the completed pantyhose into a suction duct under the hollow support.

11. The method of claim 10, wherein said jets of compressed air are applied at an angle inclined toward the interior of said hollow support.

12. The method of claim 1, including applying jets of air to the portion of the pantyhose within the hollow support after sewing of the gusset, and reversing the pantyhose after sewing thereof and drawing the completed pantyhose into a suction duct under the hollow support.

13. The method of claim 12, wherein said jets of compressed air are applied at an angle inclined toward the interior of said hollow support.

14. A method of applying a gusset to tubular outer articles such as pantyhose which have a seamless crotch zone between legs with each leg terminating in a toe section; comprising:

stretching and fastening the edge of said seamless crotch zone on the horizontal edge of an upper tubular support duct provided with suction means so that said pantyhose is in a hanging position relative to said support;

pneumatically turning the body of said pantyhose over and introducing therein the legs thereof with said toe sections in said upper tubular support;

holding said toe sections in said upper support;

mechanically placing a circular gusset on a lower horizontal circular support duct having suction means;

mechanically laying said support with said gusset thereon against said upper support so that the edge of the gusset is pressed and held fixed in juxtaposition to the stretched edge of said seamless zone of said pantyhose;

trimming excess fabric beyond the seam line of said pantyhose and said gusset;

sewing said gusset to said pantyhose; and while said pantyhose is still being held by said toe section and said upper support, allowing said pantyhose to fall down right side out into said lower tubular support and removing said pantyhose from said lower support.

15. The method of claim 14, wherein said pantyhose is disengaged from the horizontal edge of said upper tubular support by means of compressed air passed through said support and by suction in said lower support.

16. The method of claim 14, wherein the various steps are carried out simultaneously at different stations on different pantyhose articles at different stages of completion.

17. The method of claim 15, wherein the various steps are carried out simultaneously at different stations on different pantyhose articles at different stages of completion.

18. A pantyhose article made in accordance with the method of claim 14.

19. A pantyhose article made in accordance with the method of claim 1.

20. A pantyhose article made in accordance with the method of claim 6.

* * * * *